US009458584B2

(12) United States Patent
Titmus

(10) Patent No.: US 9,458,584 B2
(45) Date of Patent: Oct. 4, 2016

(54) PERIMETER SECURITY BARRIERS

(75) Inventor: Michael Thomas Titmus, West Midlands (GB)

(73) Assignee: Hill & Smith Limited (GB)

( * ) Notice: Subject to any disclaimer, the term of this patent is extended or adjusted under 35 U.S.C. 154(b) by 718 days.

(21) Appl. No.: 12/531,871

(22) PCT Filed: Mar. 20, 2008

(86) PCT No.: PCT/GB2008/000997

§ 371 (c)(1),
(2), (4) Date: Oct. 13, 2009

(87) PCT Pub. No.: WO2008/114027

PCT Pub. Date: Sep. 25, 2008

(65) Prior Publication Data

US 2010/0084623 A1 Apr. 8, 2010

(30) Foreign Application Priority Data

Mar. 20, 2007 (GB) ..... 0705267.3
Jul. 26, 2007 (GB) ..... 0714522.0

(51) Int. Cl.
*E01F 15/06* (2006.01)

(52) U.S. Cl.
CPC ..... *E01F 15/06* (2013.01)

(58) Field of Classification Search
USPC ..... 256/10, 13.1
See application file for complete search history.

(56) References Cited

U.S. PATENT DOCUMENTS 1,892,222 A 12/1932 Russell
2,009,364 A 7/1935 Tufts
2,093,577 A * 9/1937 Shepherd ..... 256/13.1
2,204,557 A 6/1940 Ahles
2,239,667 A 4/1941 Ahles
2,518,004 A 8/1950 Nevil
3,353,795 A * 11/1967 Muller ..... 256/13.1
3,499,630 A * 3/1970 Dashio ..... 256/13.1
5,039,066 A * 8/1991 Stacey ..... 256/13.1
5,145,278 A * 9/1992 Lohrmann ..... 404/6

(Continued)

FOREIGN PATENT DOCUMENTS

CH 693639 A5 11/2003
DE 1273557 A 7/1968

(Continued)

OTHER PUBLICATIONS

Search Report from UK Application No. GB0805244.1, dated Jul. 2, 2008.

(Continued)

*Primary Examiner* — Joshua Kennedy

(74) *Attorney, Agent, or Firm* — Rhodes Donahoe, LLC; Robert V. Donahoe

(57) ABSTRACT

A perimeter security barrier 1for restraining a vehicle impacting the barrier from a direction substantially perpendicular thereto is described. The barrier comprises a pair of spaced apart end posts 3, 5 rigidly fixed in the ground and intermediate posts 11*a*, 11*c*. . . disposed between the end posts are also fixed in the ground. At least one pair of wire ropes 15*c*, 15*d* is supported between the end posts and optionally woven around the intermediate posts, the ropes being secured at each end to respective end posts. Energy absorption means 21 is provided at each end for absorbing energy transmitted by the ropes from the impacting vehicle.

22 Claims, 5 Drawing Sheets

(56) References Cited

U.S. PATENT DOCUMENTS

| | | | | |
|---|---|---|---|---|
| 5,395,105 | A | 3/1995 | Thommen, Jr. | |
| 5,481,835 | A * | 1/1996 | Bloom | 52/98 |
| 6,065,738 | A * | 5/2000 | Pearce et al. | 256/13.1 |
| 6,488,268 | B1 | 12/2002 | Albritton | |
| 6,948,703 | B2 * | 9/2005 | Alberson et al. | 256/13.1 |
| 7,367,549 | B2 * | 5/2008 | Titmus | 256/13.1 |
| 7,401,996 | B2 * | 7/2008 | Neusch | 404/6 |
| 7,798,741 | B2 * | 9/2010 | Neusch | 404/6 |
| 2005/0232693 | A1 * | 10/2005 | Sharp et al. | 404/6 |
| 2006/0255937 | A1 * | 11/2006 | Wong | 340/541 |
| 2007/0284562 | A1 * | 12/2007 | Bunk et al. | 256/10 |

FOREIGN PATENT DOCUMENTS

| | | | |
|---|---|---|---|
| EP | 0018619 | A1 | 11/1980 |
| EP | 0258585 | A2 | 3/1988 |
| EP | 0369659 | A1 | 5/1990 |
| FR | 2457929 | A | 12/1980 |
| GB | 1005931 | | 9/1965 |
| GB | 1417109 | | 12/1975 |
| GB | 2406127 | | 3/2005 |
| GB | 2433285 | | 6/2007 |
| JP | 11148118 | | 6/1999 |
| JP | 2001317580 | | 11/2001 |
| WO | 2007071725 | A1 | 6/2007 |

OTHER PUBLICATIONS

Search Report from UK Application No. GB0705267.3, dated Jul. 4, 2007.

Search Report from UK Application No. GB0714522.0, dated Oct. 29, 2007.

International Search Report and Written Opinion from International Application No. PCT/GB2008/000997, dated Jun. 24, 2008.

* cited by examiner

A
B
3
5
7
9
11a
11b
11c
13a
13b
13c
15a
15b
15c, 15d
15e
15f, 15g
15a, b, c, e, f
15d
15g
15f
15e
15c
15b
15a
15g
15d
16a
16b
16c
16d
16e
16f
16g
17
19
21

PERIMETER SECURITY BARRIERS

BACKGROUND OF INVENTION

1. Field of Invention

This invention relates to perimeter security barriers, and in particular but not exclusively, to barriers that provide an effective perimeter protection against wilful intrusion around airports and the like.

2. Discussion of Related Art

Conventional perimeter security barriers are designed to withstand vehicle impacts but differ from road crash barriers in that they resist vehicle impacts in a direction substantially perpendicular to the perimeter barrier. Conventional road crash barriers, by contrast, are designed to deflect vehicles impacting the fence an angle of 15 to 25 degrees relative to the fence (i.e. low angles) at speeds up to 110 km/h (68 mph).

The problem with conventional perimeter security barriers is that they are unable to prevent transgression of heavy impacting vehicles. They are of solid construction, usually of concrete blocks, making them unsightly and difficult to install. It is therefore an aim of the present invention to provide a perimeter security barrier that can arrest heavy vehicle impacts (e.g. goods vehicles).

SUMMARY OF THE INVENTION

According to the present invention, there is provided a perimeter security barrier for restraining a vehicle impacting the barrier from a predetermined direction substantially perpendicular thereto or between 25 and 90 degrees relative to the barrier, the barrier comprising a pair of spaced apart end posts rigidly fixed in or on the ground, at least one intermediate post disposed between the end posts also fixed in the ground, and at least one wire rope between the end posts, wherein the rope is secured at each end to respective end posts, and energy absorption means is provided at said each end for absorbing energy transmitted by the ropes from the impacting vehicle. Embodiments of the present invention can therefore restrain vehicles impacting the barrier at high angles. Embodiments of the invention may be used as anti-terrorist fences and/or for restraining heavy vehicles.

In a preferred embodiment, the rope is secured to the end posts via the energy absorption means that may be configured to deform as the ropes tension under the action of the impacting vehicle. A section that deforms or collapses in the event of a vehicle impact may provide the energy absorbing means. The section may be a steel channel section or a form of rubber or plastic sandwich compound.

Barriers embodying the present invention are advantageously configured so that the height of the barrier is effective for resisting vehicle impact along its entire length between the end posts.

Any or all of the at least one wire ropes may be located at a predetermined height above the ground. Means may be provided, configured for retaining the at least one rope at this predetermined height during an impact.

In an embodiment, the at least one wire rope may be attached to one or more of the at least one intermediate posts. The attachment of the rope(s) to the intermediate posts and/or the fixing of the at least one intermediate posts in or on the ground keeps the ropes substantially at the predetermined height during an impact.

In an embodiment, the ropes may be supported on the intermediate post(s) by hooks configured to permit release of the ropes relative to the intermediate post(s) in an upward direction. In the event of an impact, the release of the ropes from the posts assists in maintaining the ropes at the desired height above the ground.

In another embodiment, any or all of the at least one intermediate posts are releasably fixed in or on the ground. Any or all of the at least one intermediate posts may be frangible or mounted on a shear base mechanism. In the event of an impact, the post shears at its base. One or more of the ropes may remain attached thereto during an impact.

In various embodiments, one or more unwoven wire ropes may be provided between the end posts, unwoven relative to the intermediate posts. A second rope may be provided and may be woven around the intermediate posts. Further ropes may be added, unwoven or woven relative to the intermediate posts. At least one of the unwoven ropes is positioned about the intermediate post and disposed on a side thereof facing the predetermined direction. In a preferred embodiment, three wire ropes, unwoven relative to the intermediate post and disposed on a side thereof facing the predetermined direction, are provided. In addition to the three unwoven wire ropes, in some embodiments, the barrier may have two pairs of wire ropes woven around said intermediate posts, one of the pairs being positioned towards the top of the end and intermediate posts, and the other pair being positioned substantially midway between the top of the posts and the ground. One of the three unwoven wire ropes may be positioned between the pairs of wire ropes and the other two of said three unwoven wire ropes may be positioned between the midway pair and the ground. The ropes are preferably tensioned between the end posts. The wire ropes may be of any suitable material, including steel strand or cable, or a high-carbon, high-tensile steel strand, or a fibre reinforced plastic material.

The intermediate posts are preferably inclined relative to the vertical towards the predetermined direction, that is, towards the oncoming vehicle. The inclination of the intermediate post(s) to the vertical may be between 0 and 45 degrees, preferably between 0 and 20 degrees, and more preferably 10 degrees.

Embodiments of the present invention are advantageous in that they may resist or prevent transgression of heavy goods vehicles impacting at speed in a direction substantially perpendicular to the perimeter or in a direction between 25 and 90 degrees to the perimeter. Embodiments may be designed to prevent access to secure areas, such as airfields or airports, by goods vehicles up to 7,500 Kg inertial mass impacting the barrier at up to 90 degrees at speeds of to 48 to 80 km/hr. Embodiments may be able to withstand impact energies in the order of 1852 KJ.

BRIEF DESCRIPTION OF THE DRAWINGS

The invention will be further described by way of example with reference to the accompanying drawings, in which.

DETAILED DESCRIPTION

FIG. 1 shows a barrier 1 having a pair of vertical end posts 3, 5 anchored into the ground by concrete blocks 7 and 9 respectively. The barrier has intermediate posts 11*a*, 11*b*, 11*c* . . . that are also anchored into the ground by being bedded in concrete blocks 13*a*, 13*b*, 13*c* The barrier 1 is intended to restrain heavy vehicles impacting from a direction that is substantially perpendicular to the line of the barrier. The strength and design detail of the posts and concrete footings is such as to prevent breach of the barrier by a heavy goods vehicle in the order of 7500 kg inertial mass impacting the barrier at a speeds of about 64-80 km/hr.

Figures 1A, 1B, 1C, 2A, 2B, 3A, 3B:
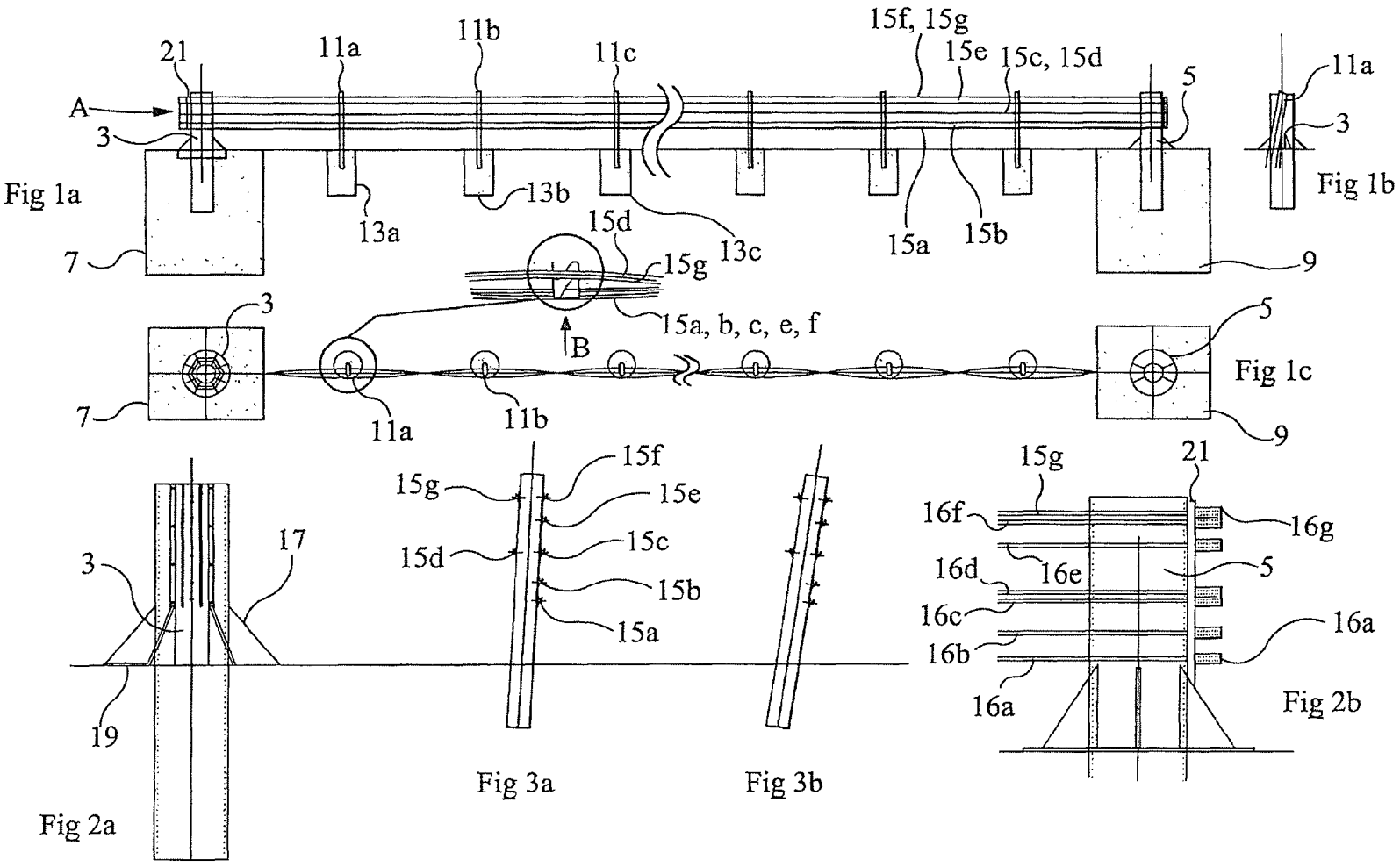
FIG. 1*a* is a front elevational view of a perimeter security barrier embodying the present invention.
FIG. 1*b* is an end view of the barrier of FIG. 1 showing the relative inclination of the intermediate posts relative to the end posts.
FIG. 1*c* is a plan view of the barrier of FIG. 1.
FIG. 2*a* is a detailed view of the end post taken in the direction of arrow A in FIG. 1*a;*
FIG. 2*b* is a front elevational detailed view of the end post.
FIG. 3*a* is a view in the direction of the arrow A of FIG. 1*a* of an intermediate post that may be adopted in embodiments of the present invention.
FIG. 3*b* is a view of a post similar to the one of FIG. 3*a* at a different inclination angle.
Figure 2C:
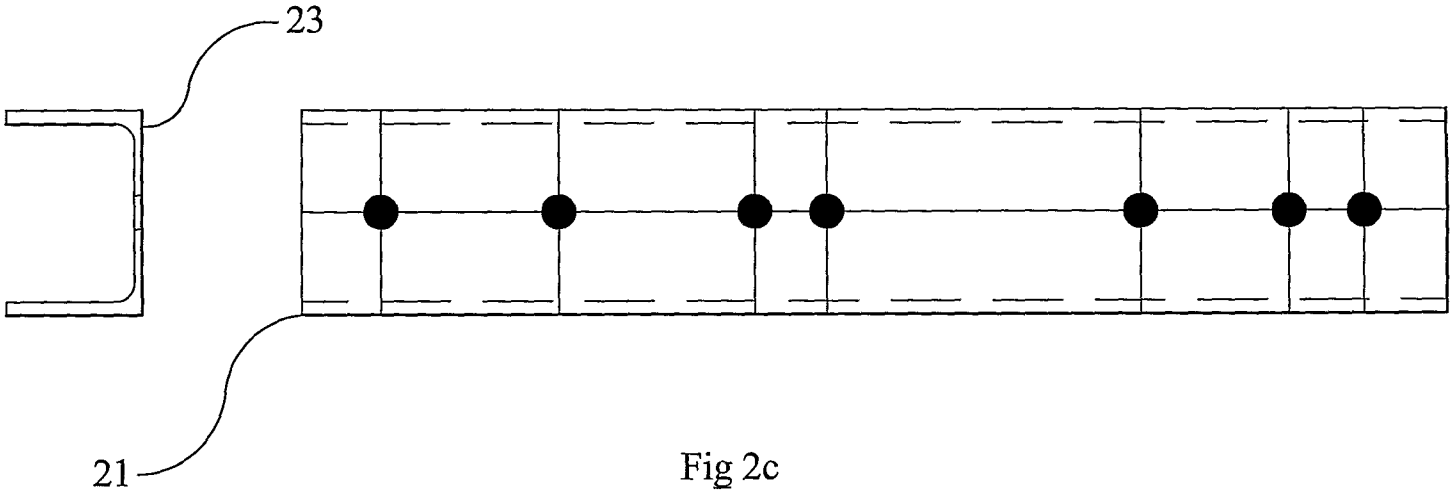
FIG. 2*c* is shows an energy absorbing device for use in embodiments of the present invention.

FIG. 1*b* is an end-view of the barrier from the direction of the arrow A from which it can be seen that the intermediate posts 11*a* . . . are inclined at an angle of 5 or 10 degrees relative to the vertical in a direction towards the anticipated impacting vehicle (travelling in the direction of arrow B).

The barrier 1 includes seven wire ropes 15*a* to 15*g* that span the line of the barrier between the end posts 3, 5. The ropes may be of high tensile steel and pretensioned between the posts 3 and 5. In this embodiment, they are arranged such that two pairs 15*c*, 15*d* and 15*f*, 15*g* respectively are sinuously wound around the intermediate posts 11*a* . . . as illustrated in the plan view of the barrier in FIG. 1*c*. FIG. 1*c* includes a detail drawing showing the ropes 15*a, b, c, e* and *f* being placed on the outer face of the intermediate post 11*a*, the outer face being defined by the side of the post 11*a* facing the incident vehicle that would be anticipated to approach the barrier 1 from the direction of the arrow B. Ropes 15*d* and 15*g* of the woven pairs 15*c*, d and 15*f, g* respectively are placed on the opposite face of the intermediate post 11*a* as shown. It follows that the ropes 15*d* and 15*g* will pass the next intermediate post 11*b* on the outer face thereof, whereas the other ropes 15*c* and 15*f* of the respective pairs will be placed on the opposite face thereof. Placement of 5 of the 7 ropes on the outer face of the intermediate posts increases the maximum resistance to perimeter ingress of the impacting vehicle. The ropes may be disposed at a height of between 300 mm and 2 meters above the ground. Ropes may be provided at varying heights above the ground, for absorbing energy from a variety of vehicles of varying sizes. An impacting vehicle impacts the ropes which pushes back on the intermediate posts. This transmitting energy to the intermediate posts adjacent to the impact zone, thereby spreading the impact load, as well as to the end posts 3 and 5 as will be described in more detail below with reference to FIG. 2*b*. The inclination of the intermediate posts maximises the plastic work contribution of the posts in restraining the loadings imposed by the impacting vehicle.

FIG. 2*a* shows the end view of the barrier 1 from the direction of the arrow A of FIG. 1*a* in more detail. Strengthening webs 17 are provided between the end post 3 and a base plate 10 that is in turn supported on the concrete footing 7. FIG. 2*b* shows the relative height positioning of the wire ropes 15*a* to 15*g*. The height position of at least some of the ropes is selected to be such that the engine of the impacting vehicle impacts them. The wire ropes pass through the post 5 and are terminated and held in tension by terminal fittings that may be in the form of bolts or other suitable mechanical gripping devices 16*a* to 16*g*. A load or energy-absorbing device 21 is provided between respective ends of the ropes and the posts 3 and 5. This device 21 may be in the form of a hot rolled channel section or hollow tube 23 that is configured to absorb energy transmitted from the impacting vehicle by the ropes. The energy-absorption means 21 is designed to deform under the increased tension load in the ropes during impact by a vehicle. This limits the peak rope loads to tolerable levels and restrains the ropes in order that they develop tension to resist penetration or breach of the barrier by the impacting vehicle.

Figure 4A:
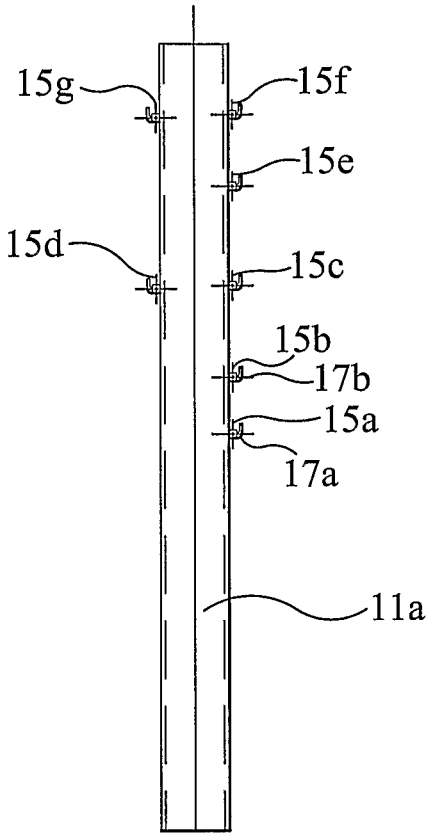
FIG. 4*a* is a detailed view of an intermediate post embodying the present invention.
Figure 4B:
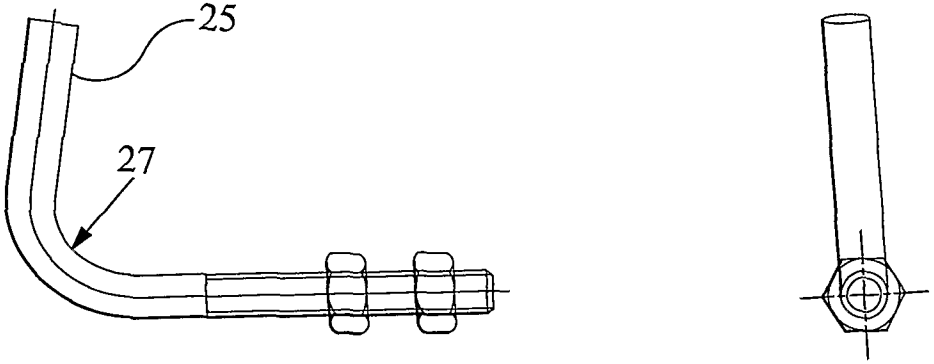
FIG. 4*b* is a support for wire ropes of the barrier.

FIGS. 3*a* and 3*b* show the inclination of an intermediate post 11(*a*), in the former case, the angle of inclination is 5 degrees and in the latter case it is 10 degrees. FIG. 4*a* is an enlarged view of the intermediate post of FIG. 3*a* or 3*b* and shows hooks 17*a* to 17*g* for supporting the wire ropes 15*a* to 15*g* such that they may be displaced and separated on impact by a vehicle in an upward direction. FIG. 4*b* is a detailed view of a hook 17*a*-17*g* formed from a stainless steel bar 25. The design parameters of the barrier 1 are such that on impact, the intermediate posts 11*a* . . . are pushed back to incline away from the impact direction by up to 40 degrees. The placement of most of the ropes on the outer face of the intermediate posts provides for spreading of the impact load across more posts so that perhaps 5 or more of these posts will be pushed and inclined backwards on impact. The angle 27 of the hook 25 is such that the cables will tend to separate from the hook when the intermediate posts are pushed back during impact.

Figure 5:
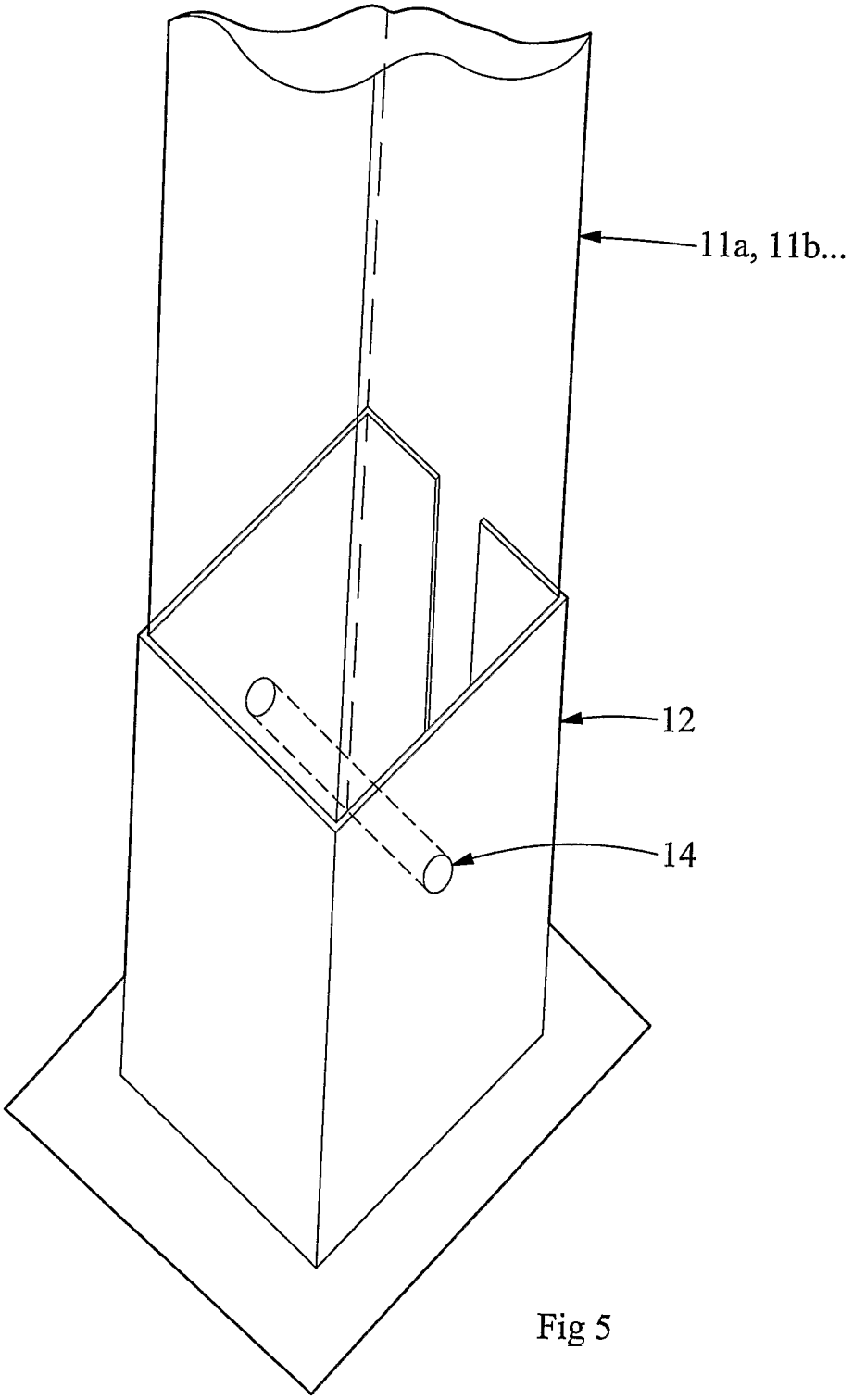
FIG. 5 shows a base of a post for an embodiment of the present invention.

In an alternative embodiment, shown in FIG. 5, the intermediate posts 11*a* . . . are releasably fixed to the ground. A mechanism may be provided at the base of the intermediate posts 11*a* . . . , that enables the post 11*a* . . . to detach from a base 12 in the event of an impact. In the embodiment shown in FIG. 5, the intermediate post 11*a* . . . may include a shear base 12 or a frangible support post. On impact, the base of the post 11*a* . . . releases from the foundation or base 12, e.g. via a shear mechanism such as a pin 14, or fracture of the material. The intermediate post 11*a* . . . in this embodiment would remain connected to one or more of the ropes 15*a* . . . and assist in maintaining the spacing of the ropes 15*a* . . . within the impacted zone to render the barrier better equipped to resist a second impact.

An electric current may be passed through one or more of the wire ropes of the barrier and coupled to detection equipment configured to permit detection of the location of an impact on the barrier. This may be used to trigger an alarm or warning device.

The invention claimed is:

1. A perimeter security barrier comprising a pair of spaced apart end posts rigidly fixed in the ground, a plurality of intermediate posts disposed between the end posts fixed in or on the ground, at least one wire rope between the end posts unwoven relative to the plurality of intermediate posts and at least one further wire rope woven relative to the plurality of intermediate posts, wherein the end posts, the plurality of intermediate posts, the at least one woven wire rope and the at least one unwoven wire rope define a plane of the barrier, the barrier being capable of arresting a vehicle impacting the barrier from a predetermined direction substantially perpendicular to, or between 25 and 90 degrees relative to, said plane of the barrier and said at least one unwoven rope is disposed only on a side of said intermediate posts to face said predetermined direction, and wherein the at least one unwoven wire rope and the at least one woven wire rope are secured at each end to respective end posts, and energy absorption means are provided at said each end for absorbing energy transmitted by the at least one unwoven wire rope and the at least one woven wire rope from the impacting vehicle, and further comprising a plurality of hooks each configured to retain one of the at least one unwoven wire rope and the at least one woven wire rope on one of the plurality of intermediate posts, respectively, wherein the plurality of hooks include an angle configured to retain the respective unwoven and woven wire ropes through an angle of inclination of the plurality of intermediate posts of 10 degrees as a result of the vehicle impact pushing the plurality of intermediate posts back, and wherein the angle of the hook is further configured to allow the respective unwoven and woven wire ropes to separate from the plurality of intermediate posts when the plurality of intermediate posts are pushed back further to increase the angle of inclination to up to 40 degrees as the result of the vehicle impact.

2. The perimeter barrier according to claim 1, wherein the at least one unwoven wire rope and the at least one woven wire rope are secured to the end posts via the energy absorption means.

3. The perimeter barrier according to claim 2, wherein the energy absorbing means are configured to deform or collapse as the at least one unwoven wire rope and the at least one woven wire rope tension under the action of the impacting vehicle.

4. The perimeter barrier according to claim 1, wherein any or all of said at least one unwoven wire rope and said at least one woven wire rope are located at a predetermined height above the ground.

5. The perimeter barrier according to claim 4, further comprising means configured for retaining the at least one unwoven wire rope and said at least one woven wire rope at said predetermined height above the ground during an impact.

6. The perimeter barrier according to claim 1, wherein an attachment of the at least one unwoven wire rope and the at least one woven wire rope to the plurality of intermediate posts and/or the fixing of the plurality of intermediate posts in or on the ground keeps the at least one woven wire rope and the at least one unwoven wire rope substantially at a predetermined height during the vehicle impact.

7. The perimeter barrier according to claim 1, wherein the hooks are configured to permit release of the respective unwoven and woven wire ropes in an upward direction.

8. The perimeter barrier according to claim 1, wherein any or all of the plurality of intermediate posts are releasably fixed in or on the ground.

9. The perimeter barrier according to claim 8, wherein any or all of the plurality of intermediate posts are mounted on a shear base mechanism.

10. The perimeter barrier according to claim 1, wherein one or more additional wire ropes is/are provided, unwoven or woven relative to the plurality of intermediate posts.

11. The perimeter barrier according to claim 10, wherein at least two of said ropes are a pair woven with respect to one another around the plurality of intermediate posts.

12. The perimeter barrier according to claim 11, further comprising one or more pairs of wire ropes woven around said plurality of intermediate posts.

13. The perimeter barrier according to claim 12, further comprising two pairs of wire ropes woven with respect to the plurality of intermediate posts, wherein a first one of the pairs of wire ropes is positioned towards the top of the end posts and the plurality of intermediate posts, and wherein a second one of the pairs is positioned substantially midway between the top of the end posts and the plurality of intermediate posts and the ground.

14. The perimeter barrier according to claim 13, wherein the barrier comprises three unwoven wire ropes, and wherein one of said unwoven wire ropes is positioned between the two pairs of wire ropes and the other two of said unwoven wire ropes are positioned between the midway pair and the ground.

15. The perimeter barrier according claim 1, wherein at least one or more of the plurality of intermediate posts is inclined relative to the vertical towards the predetermined direction.

16. The perimeter barrier according to claim 15, wherein the inclination of the plurality of intermediate posts to the vertical is between 0 and 45 degrees.

17. The perimeter barrier according to claim 1, wherein the at least one unwoven wire rope and the at least one woven wire rope are tensioned.

18. The perimeter barrier according to claim 1, wherein an electric current is passed through the at least one unwoven wire rope and the at least one woven wire rope, and wherein the at least one unwoven wire rope and the at least one woven rope are coupled to detection equipment configured to permit detection of the location of an impact on the barrier.

19. The perimeter barrier according to claim 1, wherein the barrier is an anti-terrorist barrier configured to arrest heavy vehicles.

20. A perimeter security barrier comprising a pair of spaced apart end posts rigidly fixed in the ground, a plurality of intermediate posts disposed between the end posts fixed in or on the ground, at least one wire rope between the end posts unwoven relative to the plurality of intermediate posts and at least one further wire rope woven relative to the plurality of intermediate posts, wherein the end posts, the plurality of intermediate posts, the at least one woven wire rope and the at least one unwoven wire rope define a plane of the barrier, the barrier being capable of arresting a vehicle impacting the barrier from a predetermined direction substantially perpendicular to, or between 25 and 90 degrees relative to, said plane of the barrier and said at least one unwoven rope is disposed on a side of said intermediate posts to face said predetermined direction, and wherein the at least one unwoven wire rope and the at least one woven wire rope are secured at each end to respective end posts, and energy absorption means are provided at said each end for absorbing energy transmitted by the at least one unwoven wire rope and the at least one woven wire rope from the impacting vehicle, and further comprising a plurality of hooks each configured to retain one of the at least one unwoven wire rope and the at least one woven wire rope on one of the plurality of intermediate posts at a predetermined height above the ground, respectively, means configured to retain said at least one unwoven wire rope and said at least one woven wire rope at said predetermined height above the ground during an impact, wherein the plurality of hooks include an angle configured to retain the respective unwoven and woven wire ropes through an angle of inclination of the plurality of intermediate posts of 10 degrees as a result of the vehicle impact pushing the plurality of intermediate posts back, and wherein the angle of the hook is further configured to allow the respective unwoven and woven wire ropes to separate from the plurality of intermediate posts when the plurality of intermediate posts are pushed back further to increase the angle of inclination to up to 40 degrees as the result of the vehicle impact.

21. A perimeter security barrier comprising a pair of spaced apart end posts rigidly fixed in the ground, a plurality of intermediate posts disposed between the end posts fixed in or on the ground, three wire ropes between the end posts unwoven relative to the plurality of intermediate posts and two pairs of wire ropes woven with respect to the plurality of intermediate posts, wherein the end posts, the plurality of intermediate posts, the two pairs of woven wire ropes and the three unwoven wire ropes define a plane of the barrier, the barrier being capable of arresting a vehicle impacting the barrier from a predetermined direction substantially perpendicular to, or between 25 and 90 degrees relative to, said plane of the barrier and said three unwoven ropes are disposed on a side of said intermediate posts to face said predetermined direction, and wherein the three unwoven wire ropes and the two pairs of woven wire ropes are secured at each end to respective end posts, and energy absorption means are provided at said each end for absorbing energy transmitted by the three unwoven wire rope and two pairs of woven wire ropes, and further comprising a plurality of hooks each configured to retain one of the three unwoven wire ropes and the two pairs of woven wire ropes on one of the plurality of intermediate posts, respectively, wherein a first one of the two pairs of wire ropes is positioned towards the top of the end posts and the plurality of intermediate posts, wherein a second one of the two pairs is positioned substantially midway between the top of the end posts and the plurality of intermediate posts and the ground, wherein one of the three unwoven wire ropes is positioned between the two pairs of wire ropes and two of the three unwoven wire ropes are positioned between the midway pair and the ground, wherein the plurality of hooks include an angle configured to retain the respective unwoven and woven wire ropes through an angle of inclination of the plurality of intermediate posts of 10 degrees as a result of the vehicle impact pushing the plurality of intermediate posts back, and wherein the angle of the hook is further configured to allow the respective unwoven and woven wire ropes to separate from the plurality of intermediate posts when the plurality of intermediate posts are pushed back further to increase the angle of inclination to up to 40 degrees as the result of the vehicle impact.

22. The perimeter security barrier of claim 21, wherein an elevation of at least some of the three unwoven wire ropes and the two pairs of woven wire ropes, respectively, relative to the ground is selected to place at least some of the three unwoven wire ropes and the two pairs of woven wire ropes to be struck by an engine of the vehicle.

* * * * *